United States Patent [19]

Mizohata et al.

[11] Patent Number: 4,908,548

[45] Date of Patent: Mar. 13, 1990

[54] FLUORESCENT DISPLAY DEVICE

[75] Inventors: Tadashi Mizohata, Mobara; Daiji Sakamoto, Yasugi, both of Japan

[73] Assignees: Futaba Denshi Kogyo Kabushiki Kaisha, Mobara; Hitachi Metals, Ltd., Tokyo, both of Japan

[21] Appl. No.: 191,868

[22] Filed: May 9, 1988

[30] Foreign Application Priority Data

May 9, 1987 [JP] Japan ..... 62-111677
May 9, 1987 [JP] Japan ..... 62-111678

[51] Int. Cl.[4] ..... H01J 63/02
[52] U.S. Cl. ..... 313/497
[58] Field of Search ..... 313/497

[56] References Cited

U.S. PATENT DOCUMENTS 4,047,073 9/1977 Kishino ..... 313/497
4,103,206 7/1978 Eto et al. ..... 313/497 X
4,666,548 5/1987 Eto et al. ..... 313/497 X

FOREIGN PATENT DOCUMENTS 55-30654 8/1980 Japan .
58-40523 9/1983 Japan .
58-41635 9/1983 Japan .
60-96763 2/1985 Japan .

*Primary Examiner*—Palmer C. DeMeo
*Attorney, Agent, or Firm*—Oblon, Spivak, McClelland, Maier & Neustadt

[57] ABSTRACT

A fluorescent display device capable of preventing variation or flickering of luminescence due to deformation of a mesh section. The fluorescent display device includes mesh-like control electrodes each being made of a material of which the coefficient of average thermal expansion is smaller than that of the glass substrate or a spacer frame at a temperature within the range of from 30° C. to 250° C. and is substantially equal to or larger than that of the glass substrate or the spacer frame at a temperature within a range from 30° C. to the sealing temperature of the fluorescent display device.

9 Claims, 6 Drawing Sheets

FLUORESCENT DISPLAY DEVICE

BACKGROUND OF THE INVENTION

1. Field of the Invention

This invention relates to a triode-type fluorescent display device, and more particularly to a fluorescent device which is to prevent a mesh section of a control electrode from producing thermal deformation due to impingement of electrons.

2. Description of the Prior Art

A fluorescent display device includes a box-like envelope which is evacuated to a high vacuum. In the envelope, filamentary cathodes for emitting electrons, mesh-like control electrodes for accelerating and controlling electrons emitted from the filamentary cathodes, and phosphor deposited anodes for emitting light due to impingement of electron are arranged. As an example of mounting the control electrode within the envelope, a spacer frame is generally used. In FIG. 10, a fluorescent display device using the spacer frame is illustrated. The spacer frame designated by the reference numeral 2 is formed into a size larger than a substrate 1 and includes various kinds of electrodes, such as, for example, cathode supports 4, cathode leads 4*a*, mesh fixing frames 5, control electrode leads 5*a* contiguous to the mesh fixing frames 5, and anode leads 6 each having a contact to be connected to a connection terminal provided on the substrate 1. These electrodes are integrally formed on the spacer frame 2 so as to provide an electrode assembly 3. As shown in FIG. 9, the spacer frame 2 further includes a mesh framework 10 which is provided with mesh sections 9 each comprising a mesh 7 and a mesh frame 8. The mesh framework 10 is superposed on the spacer frame 2 so that the mesh frame 8 of the mesh section 9 may be welded to the mesh fixing frame 5 at the several spots, and then the remaining of the mesh framework 10 is removed to provide control electrodes G. In addition, the electrode assembly 3 includes filamentary cathodes K stretchedly arranged on the cathode supports 4. The electrode assembly 3 thus constructed is positioned on the substrate 1, and then a casing 11 of a box-like lid shape is sealedly mounted on the substrate 1, while being heated to 450°-550° C. to cause melting of frit glass, thereby to form an envelope. Then, the leads 4*a*, 5*a* and 6 airtightly passing through sealing portions of the envelope and led out to an exterior of the envelope are separated from a frame section of the spacer frame 2.

In the fluorescent display device as described above, the leads 4*a*, 5*a* and 6 are to be led out through the sealing portions of the envelope. Accordingly, the leads 4*a*, 5*a* and 6 and the spacer frame 2 are usually made of 426 alloy (Ni: 42%, Cr: 6%, Fe: balance) which exhibits good conformability to sealing glass and has coefficient of thermal expansion close to that of sealing glass so that leakage through the sealing portions may be decreased. The mesh section 9 welded to the mesh fixing frame 5 of the spacer frame 2 is generally formed of a metal which is less expensive than 426 alloy, such as, for example, SUS 304, SUS 430 alloy or the like. 426, SUS 304, and SUS 430 alloys have coefficient of average thermal expansion as shown in the following table.

| Alloy | Coefficient of Average Thermal Expansion (/°C.) | Range of Temperature (°C.) |
|---|---|---|
| SUS 304 | $17.3 \times 10^{-6}$ | 30-200 |
| SUS 430 | $10.4 \times 10^{-6}$ | 30-200 |
| 426 Alloy | $7.6 \times 10^{-6}$ | 30-200 |

As another example of mounting the control electrode within the envelope, Japanese Patent Publication No. 30654/80 discloses a method for fixing control electrodes directly on a substrate. In the fluorescent display device of this type, control electrodes each are adhesively fixed on a connecting terminal section of a glass substrate by means of a conductive adhesive consisting essentially of Ag and frit glass. The control electrode includes a mesh portion, a rising portion and a flange portion each formed of the same metal. The control electrode is adhesively fixed by means of the flange portion on the glass substrate.

In the envelope of the fluorescent display device using the spacer frame described above, electrons emitted from the cathodes K partially become a reactive current by impinging the mesh section 9 of each of the control electrodes G. At this time, kinetic energy of the electron is converted into heat which increases a temperature of the mesh section 9, particularly, the mesh 7, as high as 200°-250° C. during operation of the fluorescent display device. The heat is also transmitted to the spacer frame 2 on which the mesh section 9 having the mesh 7 is fixed. However, an increase in a temperature of the spacer frame 2 is limited to as low as 90° C., because the mesh fixing frame 5 is integrally provided with the control electrode lead 5*a* which is led out to the exterior of the envelope. Further, as described above, the mesh section 9 is formed from the material which has coefficient of average thermal expansion larger than the mesh fixing frame 5 and the like which is formed of 426 alloy. Accordingly, the mesh section 9 fixed on the mesh fixing frame 5 at a normal temperature is subjected to thermal expansion larger than that of the spacer frame 2 during operation of the device. This causes the mesh 7 to be deformed in such a shape that a central portion thereof is projected toward the cathodes K or anodes A. If the thermal deformation of the mesh 7 is excessive, the control electrodes G contact with the cathodes K or anodes A. Even if the contact is avoided, deformation of the mesh 7 causes a variation of a distance between the control electrodes and the cathodes K, which results in a variation of density of an anode current, and makes luminescence of the displays uneven or causes flickering of the display.

In the fluorescent display device directly mounting the control electrode on the substrate, the control electrode formed of SUS 304 or SUS 430 alloy has coefficient of average thermal expansion larger than that of the glass substrate on which the control electrode is mounted. Accordingly, it is subjected to thermal expansion larger than that of the substrate, which causes the mesh to be deformed toward the cathodes or the anodes, as in the fluorescent display device using the spacer frame.

There have been several proposals for solving the above problems. However, these proposals are not satisfactory to prevent deformation of the control electrodes G.

One of these proposals is to devide a display pattern to reduce dimensions of each control electrode so that thermal deformation of each mesh may be decreased to prevent each control electrode from being contacted with other electrodes.

However, some display patterns are impossible to be devided. Also, the luminous display using control electrods decreased in dimensions results in lowering of display density.

Another proposal is made in Unexamined Japanese Utility Model Application Publication No. 96763/85 to prevent the meshes from being deformed or bulged toward a substrate by providing a part of meshes with a support pawl which is projected toward the substrate. However, it is disadvantageous in that the formation of the support pawl makes the manufacturing of fluorescent display device complicated and increase its manufacturing cost. Furthermore, the support pawl obstructs observation of the luminous display of the device.

Japanese Utility Model Publication No. 40523/83 discloses a method of mounting the control electrode by fixing mesh grids with respect to a spacer frame while being expanded by heating at an operating temperature of a display device so that tensile stress may be exerted on a mesh section at a normal temperature. However, it is extremely difficult to mount the mesh grids at the operating temperature which is normally above 250° C., and also the spacer frame may be deformed.

A further proposal is made in Japanese Utility Model Publication No. 41635/83 to prevent deformation at the mesh section by providing a portion of the mesh section with a notch to reduce an area of control electrodes. However, this makes the manufacturing of fluorescent display device too complicated and increases its manufacturing cost.

In view of the foregoing, the inventors have proposed a mesh used in the fluorescent display device which is formed of a metal having coefficient of average thermal expansion smaller than that of 426 alloy from which a spacer frame is formed so that the spacer frame may be subjected to thermal expansion larger than the mesh when the device is operated. In an experiment where 42 alloy (Ni: 42%, Fe: balance), which is conventionally used for a lead frame of an IC or the like, coefficient of average thermal expansion of which is $4.0\text{–}4.7\times10^{-6}/°$ C. at a temperature of 30°–450° C. is used for the mesh, the mesh is stretched beyond its elongation limit by the spacer frame which is larger in thermal expansion than the mesh and is broken during the sealing step in which the fluorescent display device is exposed to a high temperature of 450°–550° C. As shown in FIG. 7, difference in elongation percentage between 42 alloy and 426 alloy is increased as a temperature rises. Furthermore, elastic limit of metals generally decreases as an environmental temperature rises. In view of these facts, it is noted that the mesh made of 42 alloy is subjected to plastic deformation at a temperature (about 500° C.) during the sealing step. Thus, the above problems are not satisfactorily solved, if the metal having the coefficient of average thermal expansion smaller than 426 alloy is used for the mesh.

Further, it is noted that the grid directly mounted on the glass substrate in the fluorescent display device is free from breakages at the sealing temperature of above 400° C. if the coefficient of average thermal expansion of the grid is larger than the glass substrate, because tension is prevented from being applied to the mesh. Furthermore, it is free from breakage below the driving temperature of 250° C. if the coefficient of average thermal expension of the grid is smaller than that of the glass substrate, because tension is applied to the mesh to decrease deformation of the grid.

In light of these facts, the inventors have found that the material for the mesh should have the following properties in order to solve the above problems:

(1) The material has a coefficient of average thermal expansion smaller than that of the glass substrate at a temperature within the range of room temperature through 250° C., and preferably smaller than 426 alloy;

(2) At a temperature above 250° C., the material has a coefficient of average thermal expansion close to that of 426 alloy at a temperature of 30° C. through 400° C.; and (3) Inasmuch as the difference in elongation percentage between the material and 426 alloy exerts tension to the meshes, the difference in coefficient of average thermal expansion between both materials should be within an elastic limit of the material. Namely, the difference in elongation percentage between both materials is preferably at 0.1% or less.

FIG. 8 shows relationships between elongation percentage as a function of temperature in the mesh material which satisfies the above properties (1) to (3) in contrast with 426 alloy.

SUMMARY OF THE INVENTION

The present invention has been made in view of the foregoing problems in the prior art.

Accordingly, it is an object of the present invention to provide a fluorescent display device wherein a mesh is formed of a metal having coefficient of average thermal expansion smaller than that of glass or 426 alloy at a temperature below 250° C. and substantially equal to or larger than that of glass or 426 alloy at a temperature above 250° C.

In accordance with the present invention, the fluorescent display device includes phosphor-deposited anodes provided on a glass substrate, mesh-like control electrodes arranged above the anodes, filamentary cathodes stretchedly arranged above the control electrodes and an envelope which is kept at a high vacuum to accomodate the anodes, control electrodes and filamentary cathodes therein. The mesh-like control electrodes each are made of a material, coefficient of average thermal expansion of which is no more than that of glass and/or a material for a spacer frame at a temperature within the range from 30° C. to 250° C. which is the temperature of mesh during operation of the fluorescent display device and is no less than that of glass and/or the material for the spacer frame at a temperature within a range of 30° C. through the sealing temperature of the fluorescent display device.

In the fluorescent display device of the present invention, plastic deformation is absent in the mesh even when the overall envelope is heated to a high temperature which causes melting of sealing glass in the sealing operation of the device, because coefficients of average thermal expansion of both the mesh and the spacer frame are substantially equal. In other words, there is no significant difference in elongation between the mesh and the spacer frame, and the mesh is not subjected to the tension exceeding the elastic limit thereof.

Also, during operation of the fluorescent display device, thermal elongation of the spacer frame is greater than that of the mesh, thereby to apply moderate tension within the elastic limit to the mesh. In addition, the fluorescent display device of the present invention prevents deformation of the grid if it is directly mounted on the glass substrate, because the coefficient of average thermal expansion of the grid is smaller than that of the glass substrate at a temperature between 30° C. and 250° C.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a fluorescent display device according to the present invention will be described hereinafter with reference to the accompanying drawings.

Figure 9:
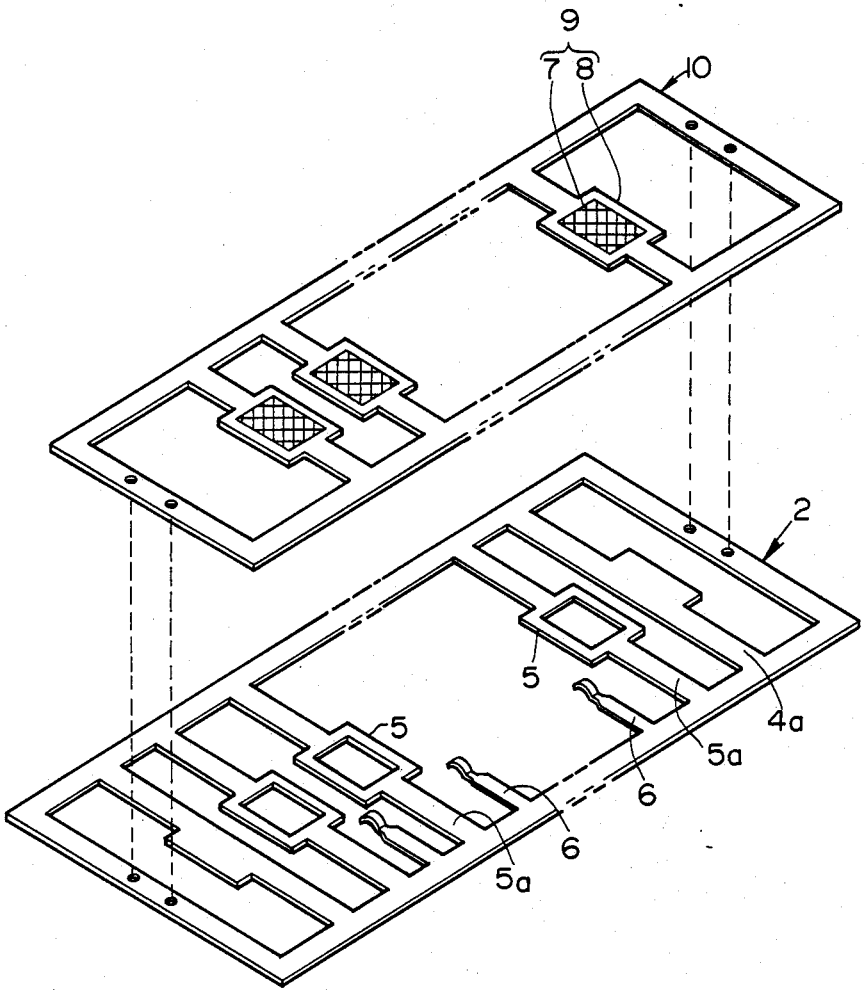
FIG. 9 is a perspective view showing a spacer frame and a mesh frame used in a fluorescent display device.
Figure 10:
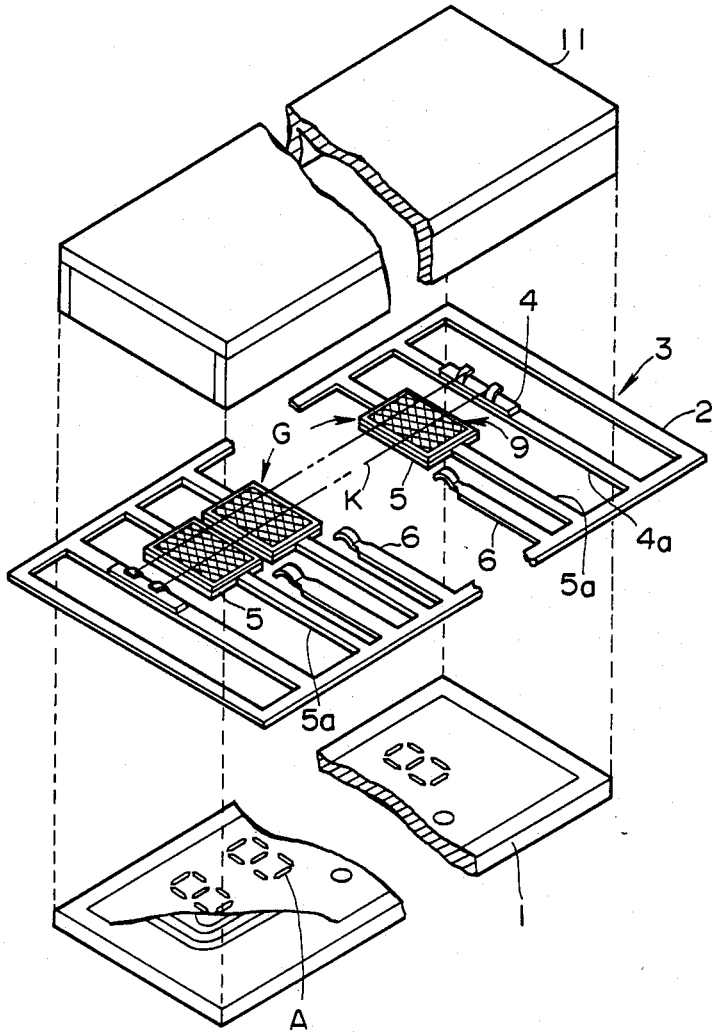
FIG. 10 is an exploded perspective view showing a fluorescent display device using the spacer frame.

A fluorescent display device of the present invention which will be described hereinafter is of substantially the same configuration and structure as those of the fluorescent display device described above. Accordingly, the following description will be made with reference to FIGS. 9 and 10 as well as FIGS. 1 to 8.

Figure 1:
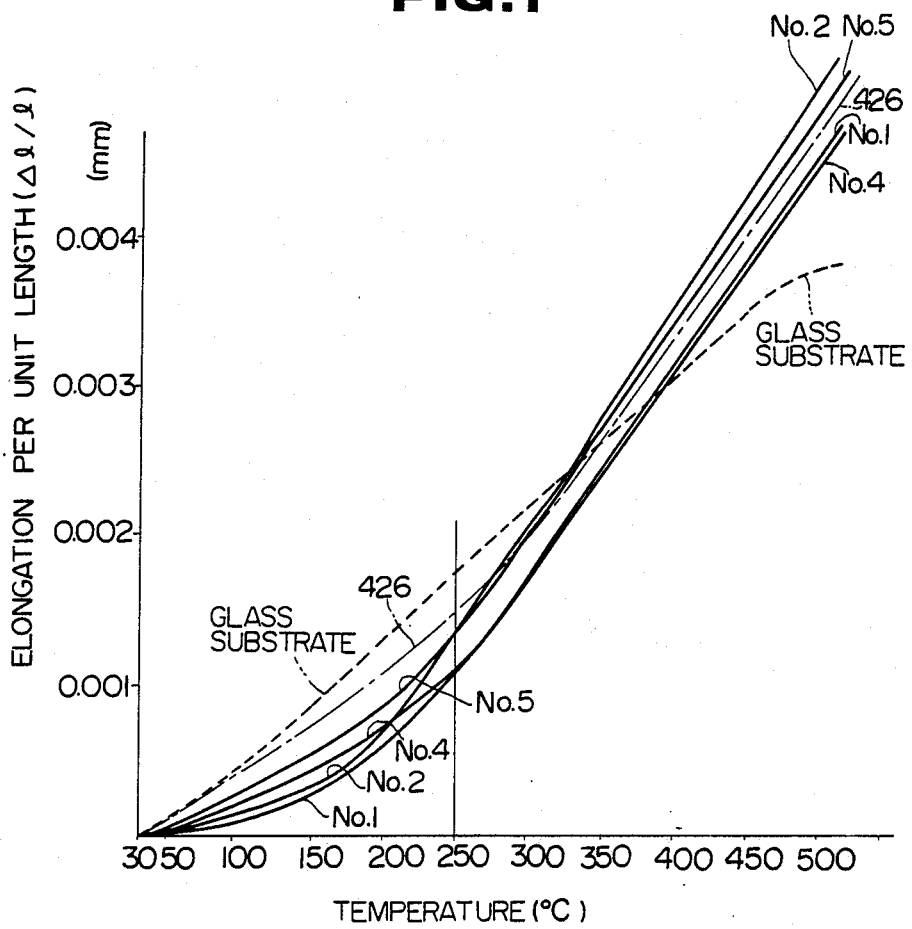
FIG. 1 is a graphic representation showing the relationships between the rate of elongation and the temperature in each of the alloys, 426 alloy and glass substrate employed in the present invention.
Figure 2:
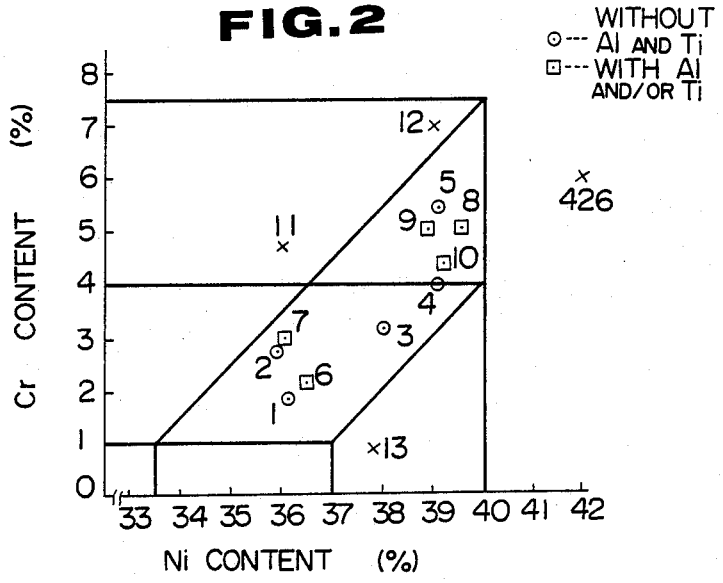
FIG. 2 is a graphic representation showing the relationships between the content of Ni and that of Cr in alloys used for the present invention.

The fluorescent display device according to the present invention is characterized in that a mesh 7 of each control electrode G is made of a novel alloy which is entirely different from a conventional mesh material. Now, the alloy will be described in detail. The alloy has a composition of 0.05 wt. % or less C, 0.05–0.50 wt. % Mn, 33.5–40.0 wt. % Ni, 1.0–7.5 wt. % Cr and the balance Fe and satisfying 32.5 wt. % $\leqq$ Ni–Cr $\leqq$ 36 wt. %. It may contain at least one of 0.05–0.50 wt. % Al and 0.05–0.50 wt. % Ti as desired in addition to the above composition. TABLE 1 shows the chemical composition and coefficient of average thermal expansion of ten kinds of the alloy (Specimen No. 1 to 10) used in the embodiment of the present invention as well as 426 alloy (Specimen No. 426) and 18 Cr stainless steel (Specimen No. 18) which are conventionally used. In FIG. 2, contents of Ni and Cr in each of Specimen Nos. 1 to 10 are plotted and the range of the contents is shown. FIG. 1 shows relationships between the rate of elongation ($\Delta l/l$) which refers to elongation per unit millimeter and the temperature in Specimen Nos. 1, 2, 4, 5 and 426 and a glass substrate.

TABLE 1

| | Chemical Composition (wt. %) | | | | | | | | Coefficient of Average Thermal Expansion ($\times 10^{-6}$/°C.) | | |
|---|---|---|---|---|---|---|---|---|---|---|---|
| No. | C | Si | Mn | Ni | Cr | Al | Ti | Fe | α 30–200 | α 30–400 | α 30–250 |
| 426 | 0.01 | 0.26 | 0.18 | 41.3 | 6.0 | 0.18 | — | BAL | 7.3 | 9.9 | 7.4 |
| 18 | 0.04 | 0.37 | 0.50 | — | 18.2 | — | 0.52 | BAL | 10.8 | 11.4 | 10.8 |
| 1 | 0.01 | 0.25 | 0.19 | 36.2 | 1.8 | — | — | BAL | 4.5 | 10.1 | 5.9 |
| 2 | 0.01 | 0.22 | 0.18 | 35.9 | 2.8 | — | — | BAL | 5.1 | 10.5 | 6.7 |
| 3 | 0.01 | 0.15 | 0.26 | 38.0 | 3.1 | — | — | BAL | 5.0 | 9.2 | 5.7 |
| 4 | 0.01 | 0.23 | 0.19 | 39.0 | 3.9 | — | — | BAL | 5.4 | 9.2 | 5.9 |
| 5 | 0.01 | 0.22 | 0.19 | 39.1 | 5.4 | — | — | BAL | 6.6 | 10.7 | 7.2 |
| 6 | 0.01 | 0.12 | 0.32 | 36.5 | 2.2 | 0.09 | — | BAL | 4.7 | 10.0 | 6.0 |
| 7 | 0.01 | 0.20 | 0.27 | 36.0 | 2.9 | 0.37 | — | BAL | 5.3 | 10.6 | 6.6 |
| 8 | 0.01 | 0.18 | 0.11 | 39.5 | 5.0 | — | 0.11 | BAL | 6.2 | 10.0 | 6.6 |
| 9 | 0.01 | 0.31 | 0.10 | 38.8 | 5.0 | — | 0.45 | BAL | 6.4 | 10.3 | 6.9 |
| 10 | 0.01 | 0.30 | 0.08 | 39.2 | 4.3 | 0.20 | 0.31 | BAL | 5.8 | 9.5 | 6.3 |

The reasons why a chemical composition of the alloy used in the embodiment is limited to the above ranges are as follows.

It is required to include C (carbon) in the alloy to a certain degree as a deoxidizer in the manufacturing of the alloy. However, a content of C above 0.05 wt. % produces bubbles in glass used in the fluorescent display device when it is sealed. Accordingly, the content is limited to no more than 0.05 wt. %. Si is used as a deoxidizer during melting of the alloy. The content below 0.05 wt. % is ineffective as a deoxidizer, whereas the content above 0.50% deteriorates workability of the alloy. Accordingly, the content is limited within a range of 0.05 wt. % through 0.50 wt. %. The same is true of Mn. Ni and Cr are basic components of the alloy and significantly contribute to thermal expansion characteristics. A content of Ni between 33.5 wt. % and 40.0 wt. %, a content of Cr between 1.0 wt. % and 7.5 wt. %, and 32.5 wt. %≦amount of Ni−amount of Cr≦35 wt % cause the coefficient of average thermal expansion of the alloy to be smaller than that of the glass substrate and preferably that of 426 alloy on a low temperature side between 30° C. and 250° C. and larger than that of the glass substrate and preferably that of 426 alloy on a high temperature side between 250° C. and 400° C., namely the range defined by a trapezoid in FIG. 2.

The content of Ni in the alloy affects the coefficient of thermal expansion of the alloy on a lower temperature side of 30°-250° C. The higher content of Ni results in an increase in the coefficient of average thermal expansion of the alloy and elongation rate of the mesh. In the present invention, the elongation rate of the mesh is set to be smaller than that of the mesh fixing member, which is the glass substrate or the spacer frame in the fluorescent display device at the operation temperature of 30°-250° C. of the fluorescent display device so that moderate tension may be applied to the mesh which does not cause deformation and/or peeling of the mesh, thereby to decrease or minimize the amount of bulge or displacement of the mesh.

In the fluorescent display device in which the control grid is directly mounted on the glass substrate, the elongation rate of the mesh is slightly smaller than the glass substrate. To the contrary, in the fluorescent display device using the spacer frame, the elongation rate of the mesh may be somewhat smaller than 426 alloy. If the elongation rate of the mesh is too small, excessive tension is applied to the mesh, which causes peeling of the mesh in the fluorescent display device directly mounting the grid on the glass substrate. Such a peeling does not occur at the mesh in the fluorescent display device using the spacer frame, because it is mounted by spot welding, although there is a possibility of deforming the mesh.

The content of Ni in the alloy which satisfies the aboveconditions is between 33.5 wt. % and 40 wt %. In view of the distribution defined by the trapezoid in FIG. 2, the alloy is divided into two groups by its Ni content of 37 wt. %. For example, the group in which the content is below 37 wt. % (hereinafter referred to as "lower group") includes Specimen Nos. 1 and 2 in FIG. 1, whereas the group in which the content is above 37 wt. % (hereinafter referred to as "upper group") includes Specimen Nos. 4 and 5.

As is apparent from FIG. 1, the elongation ratio of the upper group is smaller than or substantially equal to that of the sheet glass or 426 alloy. Therefore, the peeling and deformation of the mesh is completely prevented irrespective of application of tension to the mesh.

Accordingly, an alloy of which Ni content is 37 wt. % and 40 wt. % is preferably used as a mesh material for the fluorescent display device of the present invention. The content of Cr in the alloy is between 1.0 wt. % and 7.5 wt. % and the difference between the Ni content and the Cr content is between 32.5 wt. % and 36 wt. % (32.5 wt. %≦Ni-Cr≦36 wt. %).

TABLE 2 shows alloys (Specimen Nos. 11-13) which fail to meet the above requirements.

TABLE 2

| | Chemical Composition (wt. %) | | | | | | | | Coefficient of Average Thermal Expansion ($\times 10^{-6}$/°C.) | | |
|---|---|---|---|---|---|---|---|---|---|---|---|
| No. | C | Si | Mn | Ni | Cr | Al | Ti | Fe | α 30-200 | α 30-400 | α 30-250 |
| 11 | 0.01 | 0.23 | 0.19 | — | 4.7 | — | — | BAL | 7.1 | 11.6 | 8.3 |
| 12 | 0.01 | 0.23 | 0.19 | 39.1 | 6.8 | — | — | BAL | 7.4 | 11.5 | 8.6 |
| 13 | 0.01 | 0.20 | 0.25 | 37.7 | 0.9 | — | — | BAL | 3.5 | 8.0 | 4.2 |

The alloys shown in TABLE 2 are also shown in FIG. 2 for comparison with alloy of the present invention. When the composition is out of the range of the trapezoid, the coefficient of average thermal expansion 30-250 is out of the range between $5.0\times10^{-6}$/° C. and $7.3\times10^{-6}$/° C. as well. When it exceeds $7.3\times10^{-6}$, the mesh is subjected to thermal expansion during the operation of the fluorescent display device as described above, whereas if it is below $5.0\times10^{-6}$/° C., excessive tension is exerted on the mesh.

Al and Ti are components which may be included in the alloy to improve adhesion of an oxide film to a matrix of the alloy as desired. The content of each of Al and Ti in the alloy is ineffective, if it is below 0.05 wt. %. To the contrary, if the content is above 0.50 wt. %, workability of the alloy is significantly decreased. Thus, the content of each of Al and Ti should be between 0.05 wt. % and 0.50 wt. %.

The alloy consisting of the chemical compositions described above has a coefficient of average thermal expansion smaller than 426 alloy at the operating temperature of 30°-250° C. of the fluorescent display device. It is generally within a range of $5.0\times10^{-6}$/° C. through $7.3\times10^{-6}$/° C. Accordingly, as is apparent from FIG. 1, 426 alloy has an elongation rate larger than that of alloy of Specimen Nos. 1, 2, 4 and 5 at a temperature up to about 250° C. and both have substantially the same elongation rate at a temperature above 250° C.

Specimen Nos. 1 to 10 each are manufactured by melting a material consisting of the compositions shown in TABLE 1 in a vacuum induction furnace, and then subjecting it to hot rolling and cold rolling to obtain an alloy steel material. Now, manufacturing of the fluorescent display device which uses a mesh section 9 made of the alloy thus prepared will be described.

First, an Al film is deposited on a glass substrate 1 by sputtering and is formed into anode conductors and wiring conductors each having a desired pattern by photolithography. Subsequently, an insulating layer of a relatively large thickness is deposited on the glass substrate 1 so as to surround each of the anode conductors by screen printing and is subjected to burning. Thereafter, a phosphor layer is deposited on the anode conductor by electrodepositing or screen printing, and then it is subjected to burning.

Then, an electrode assembly 3 including control electrodes is prepared. A spacer frame 2 is formed by subjecting 426 alloy having a coefficient of average thermal expansion substantially equal to that of glass to pressing or etching. The spacer frame 2 thus prepared is subjected to a heat treatment in a hydrogen furnace in advance to form a layer of chromium oxide on the surface thereof so as to improve its adhesion to sealing glass. As described above, it is preferable to use the heat treated 426 alloy in the spacer frame 2 which passes through the sealing portion of the envelope and contacts with the sealing glass. The electrode assembly may be prepared by having the spacer frame 2 made of 426 alloy connected to the remaining electrodes which are separately prepared from other metal by welding.

A sheet material made of alloy of Specimen Nos. 1 to 10 is subjected to etching to form a mesh framework 10 including a plurality of mesh sections 9 each comprising a mesh 7 and a mesh frame 8. Then, the mesh framework 10 is superposed on the spacer frame 2. Each of the mesh frames 8 is welded to the corresponding mesh fixing frame 5 and the mesh section 9 is separated from the mesh framework 10. Filamentary cathodes K are welded to cathode supports 4 so that they may be stretched above the mesh sections 9.

Subsequently, side plates and a cover plate, both made of glass, are assembled into a casing 11 having a box-like lid shape by means of frit glass of a low melting point. The electrode assembly 3 is arranged on the glass substrate 1 and then the casing 11 is put on the substrate. The casing 11 and glass substrate 1 are sealedly bonded by means of frit glass melted due to heating while interposing lead sections 4*a*, 5*a* and 6 of the spacer frame 2 therebetween, thereby to form an envelope. The bonding is generally carried out at a temperature of from 450° C. to 550° C. As shown in FIG. 1 and TABLE 1, alloy of Specimen Nos. 1–10 have an elongation rate substantially equal to that of 426 alloy in this temperature range. Accordingly, in the sealing step of the fluorescent display device, the amount of thermal deformation of the spacer frame 2 made of 426 alloy becomes substantially equal to that of the mesh section 9 formed of alloy of Specimen Nos. 1–10, and the possibility of plastic deformation of any one of the spacer frame 2 and mesh section 9 is eliminated.

Thereafter, the envelope is evacuated through evacuation holes so that an interior thereof is kept at a high vacuum and then the holes are closed with lids or chip tubes. Finally, lighting is carried out to activate the cathodes and then aging is effected.

Now, the manner of operation of the fluorescent display device will be described.

Figure 3:
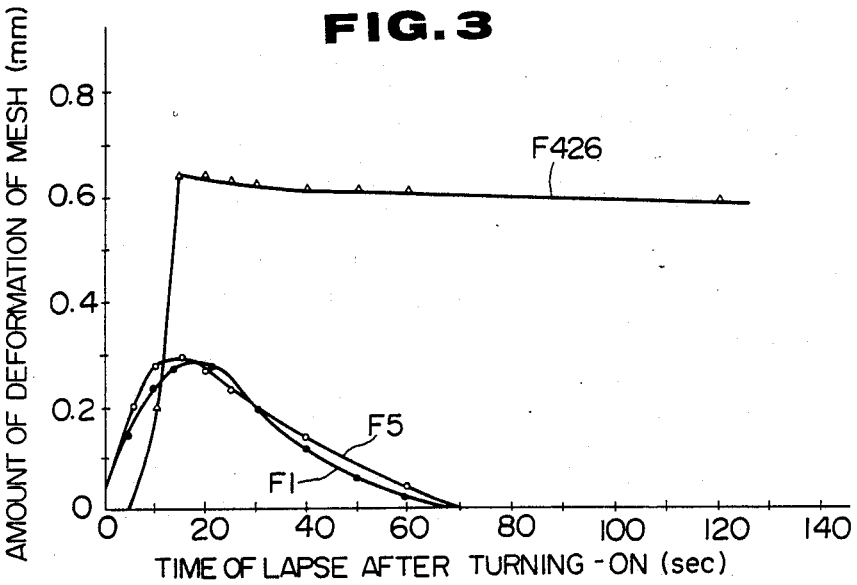
FIG. 3 is a graphic representation showing the relationships between the amount of deformation of the mesh and the time elapsed after turning-on a fluorescent display device in each of the prior art and the present invention.

As shown in FIG. 1 and TABLE 1, alloy of Specimen Nos. 1 to 10 have a coefficient of average thermal expansion smaller than that of a 426 alloy at a temperature below about 250° C. which is the maximum temperature during operation of the fluorescent display device. Accordingly, during operation of the fluorescent display device, the amount of deformation of the mesh 7 of the mesh section 9 is small as compared to that of the spacer frame 2. The mesh in the fluorescent display device is not only decreased in the amount of deformation as compared to the conventional mesh during the operation, but decreased in the amount of deformation as time passes after the operation, which becomes eventually substantially zero. As shown in FIG. 3, in the conventional fluroescent display device F426 fixing the mesh section 9 made of a metal having a coefficient of average thermal expansion larger than 426 alloy on the spacer frame, the mesh is subjected to thermal expansion immediately after the device is energized, and the amount of deformation of the mesh is kept substantially constant irrespective of the lapse of time. To the contrary, in each of fluorescent display devices F1 and F5 according to the embodiment of the present invention fixing the mesh section formed of alloy of Specimen Nos. 1 and 5 on the spacer frame, the maximum amount of deformation of the mesh is reached in about fifteen seconds after the device is energized. However, the maximum amount of deformation is small as compared to that in the conventional device F426 and the amount of deformation is decreased with the lapse of time and returns to the original shape in about one minute.

Figure 4:
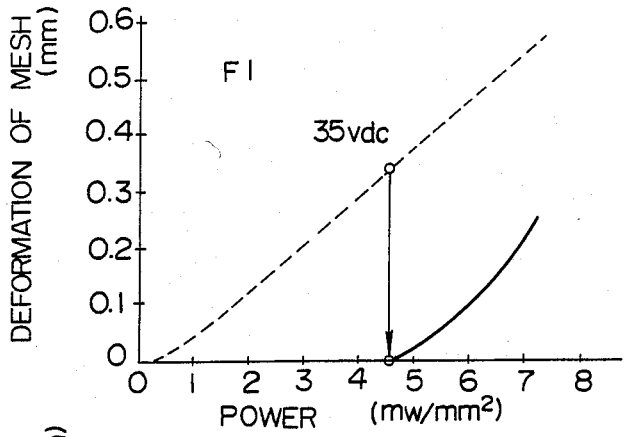
FIGS. 4 and 5 each are a graphic representation showing the relationships between power per unit area of a control electrode and the amount of deformation of a mesh during operation of a fluorescent display device according to the present invention using different alloys.
Figure 5:
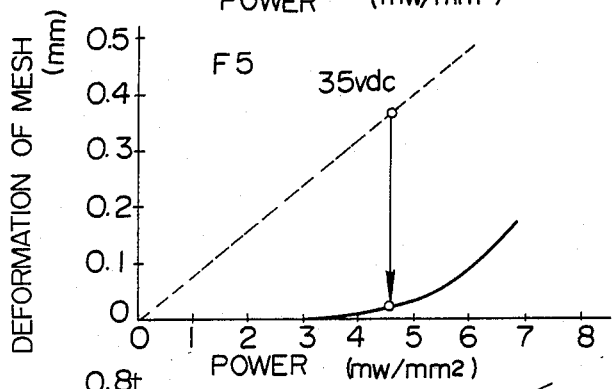
Figure 6:
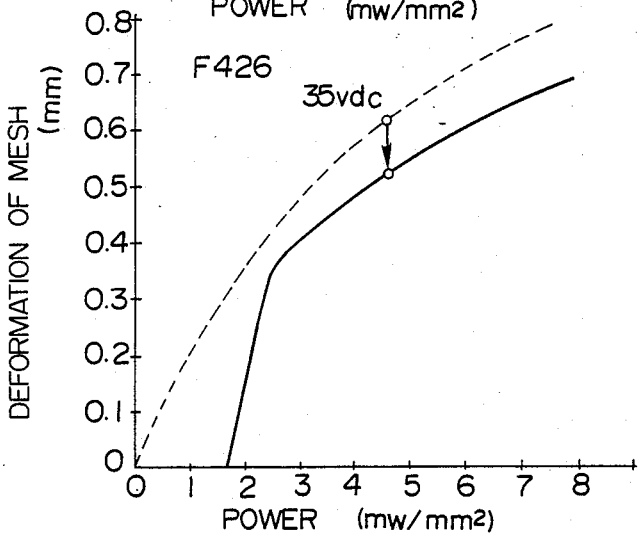
FIG. 6 is a graphic representation showing the relationships between power per unit area of the control electrode and the amount of deformation of the mesh during operation of a conventional fluorescent display device.
Figure 7:
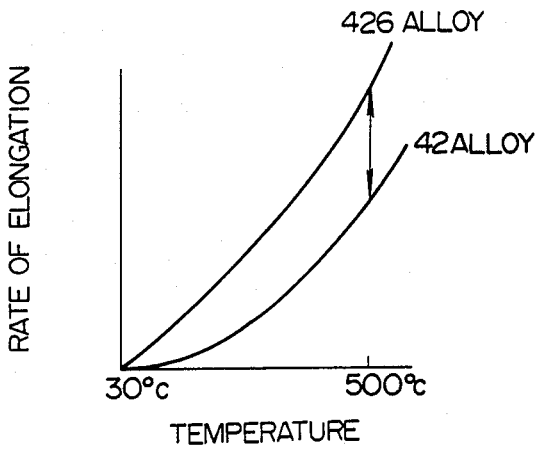
FIG. 7 is a graphic representation showing the relationships between the temperature and the rate of elongation in each of 42 alloy and 426 alloy.
Figure 8:
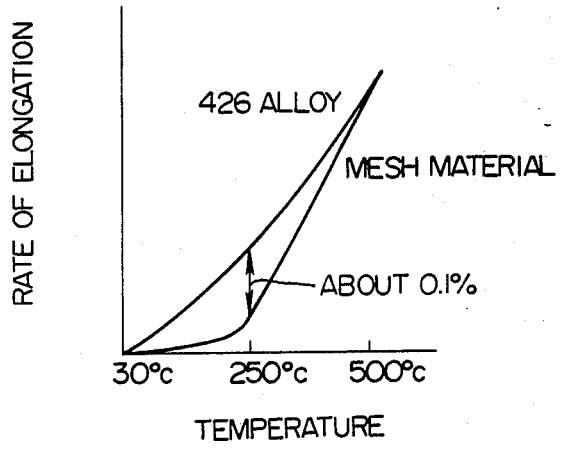
FIG. 8 is a graphic representation exemplifying comparison of a material for a mesh according to the present invention with 426 alloy.

The reasons why the mesh made of alloy of Specimen Nos. 1 to 10 is raised with the lapse of time and then gradually decreased in the amount of deformation during the operation of the fluorescent display device are as follows. FIGS. 4 to 6 shows relationships between power per unit area of the control electrode during operation and the amount of deformation of the mesh in the fluorescent display devices F1 and F5 and the conventional fluorescent display device F426, respectively. As shown in FIG. 3, the amount of deformation of the mesh in each of the fluorescent display devices reaches its maximum in about fifteen seconds after the turning-on. In FIGS. 4 to 6, the maximum amount of deformation of the mesh after the lapse of fifteen seconds and the amount of deformation of the mesh after the lapse of one minute are indicated by a broken lines and a solid line at every power per unit area of the control electrode, respectively. The mesh section 9 of smaller heat capacity is increased in temperature immediately after turning-on of the device due to the difference in heat conduction between the mesh section 9 and the spacer frame 2, and maximum thermal deformation occurs in about fifteen seconds. At this time, the spacer frame 2 of a larger heat capacity is not subjected to thermal deformation, because of its low temperature. After the lapse of fifteen seconds, heat is transmitted to the spacer frame 2 of 426 alloy. At this time, an increase in the temperature of the spacer frame 2 is less than that of the mesh section 9. However, the coefficient of average thermal expansion of the spacer frame 2 is larger than that of the mesh section 9. Accordingly, elongation of the spacer frame 2 is larger than that of the mesh section 9. Thus, the mesh section 9 which is smaller in coefficient of average thermal expansion is decreased in the thermal expansion as compared with the spacer frame 2 with the lapse of time. Accordingly, the mesh 7 is pulled by the mesh fixing frame 5 of the spacer frame 2, and the amount of deformation of the mesh being decreased. A decrease in the amount of deformation of the mesh leads to an increase in an interval between the cathodes and the control electrodes, which reduces a current flowing through the control electrodes and the temperature of the mesh section 9. As a result, the amount of the deformation of the mesh section 9 is decreased, and the amount of deformation of the mesh section 9 is decreased to substantially zero in about one minute after turning-on of the device as indicated by the solid line in each of FIGS. 4 and 5. As is noted from FIGS. 4 and 5, the mesh section 9 made of the alloy described above causes the amount of deformation thereof to be decreased to substantially zero different from the prior art shown in FIG. 6, even when it is applied to a fluorescent display device of large power consumption.

When thermal expansion of the mesh section 9 is smaller than that of the spacer frame and the amount of deformation is zero, tension is applied to the mesh 7. In this instance, the tension must be below an elastic limit of the material. For example, when a difference in elongation between 426 alloy and the mesh material is within 0.1%, the mesh is not subjected to plastic deformation and the fluorescent display device may be stably operated.

Thus, the fluorescent display device of the present invention permits deformation of the mesh to minimize during the operation. For example, it is possible to decrease deformation of the mesh to zero, which stabilizes its operation in about one minute after turning-on of the device and eliminates flickering of luminescence of the display. Also, the fluorescent display device effectively prevents breakage of the mesh during sealing of the envelope.

The above description has been made in connection with the fluorescent display device using the lead frame wherein the mesh section is made of the alloy according to the present invention. However, the alloy used in the fluorescent display device of the present invention is appliable to the display device of a different type. For example, the alloy may be used for a grid which is directly mounted on a substrate of the fluorescent display device to decrease deformation of the grid during the operation.

As can be seen from the foregoing, the present invention effectively prevents contact between anodes and control electrodes and the variation or flickering of luminescence due to deformation of the mesh section, to thereby exhibit a uniform luminous display.

Also, the present invention eliminates deformation of the mesh section. Accordingly, the control electrodes are divided into sections of large dimensions, which makes it possible to improve the design of the fluorescent display device and formation of a display pattern at a high density.

Further, the present invention is so constructed that the mesh section has a coefficient of average thermal expansion substantially equal to that of the spacer frame at the temperature range during sealing of the fluroescent display device so that deformation of the mesh during the sealing may be effectively prevented.

While a preferred embodiment of the present has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A fluorescent display device comprising:

a glass substrate;

phosphor-deposited anodes provided on said glass substrate;

control electrodes provided above said anodes;

filamentary cathodes stretchedly arranged above said control electrodes; and an envelope kept at a high vacuum to accommodate said anodes, control electrodes and filamentary cathodes;

said control electrodes being made of an alloy of which the coefficient of average thermal expansion is smaller than that of said glass substrate and that of 426 alloy at a temperature within the range of from 30° C. to 250° C. and is substantially equal to or larger than that of said glass substrate and that of 426 alloy at a temperature within the range of from 30° C. to the sealing temperature of the fluorescent display device.

2. The fluorescent display device as defined in claim 1, wherein said control electrodes are in the shape of a mesh.

3. The fluorescent display device as defined in claim 2, wherein said control electrodes are provided above said anodes by means of a spacer frame.

4. The fluorescent display device as defined in claim 2, wherein said control electrodes are provided above said anode by having said control electrodes directly mounted on said glass substrate.

5. The fluorescent display device as defined in claim 3, wherein said spacer frame is made of a material of which the coefficient of average thermal expansion is smaller than that of said glass substrate at a temperature within the range of from 30° C. to 250° C., larger than that of said control electrodes at a temperature within the range of 30° C. to 250° C., and is substantially equal to or larger than that of said glass substrate at a temperature within the range of from 30° C. to the sealing temperature of the fluorescent display device.

6. The fluorescent display device as defined in claim 5 wherein the material for said spacer frame is 426 alloy.

7. The fluorescent display device as defined in claim 1, wherein the material for said control electrodes has a coefficient of average thermal expansion of $5.0\times10^{-6}$ to $7.3\times10^{-6}$/° C.

8. The fluorescent display device as defined in claim 1, wherein the material for said control electrodes has a composition consisting essentially of 33.5–40.0 wt. % Ni, 1.0–7.5 wt. % Cr and the balance Fe and incidental impurities and satisfying 32.5 wt. % $\leqq$ Ni–Cr $\leqq$ 36 wt. %.

9. The fluorescent display device as defined in claim 8, wherein said material for said mesh section contains at least one of 0.05–0.50 wt. % Al and 0.05–0.50 wt. % Ti.

* * * * *